US009805921B2

(12) United States Patent
O'Brien et al.

(10) Patent No.: US 9,805,921 B2
(45) Date of Patent: Oct. 31, 2017

(54) AMBIENT INFRARED LASER ABLATION MASS SPECTROMETRY (AIRLAB-MS) WITH PLUME CAPTURE BY CONTINUOUS FLOW SOLVENT PROBE

(71) Applicants: Jeremy T. O'Brien, Cambridge, MA (US); Evan R. Williams, Oakland, CA (US); Hoi-Ying N. Holman, Oakland, CA (US)

(72) Inventors: Jeremy T. O'Brien, Cambridge, MA (US); Evan R. Williams, Oakland, CA (US); Hoi-Ying N. Holman, Oakland, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 0 days.

(21) Appl. No.: 14/740,176

(22) Filed: Jun. 15, 2015

(65) Prior Publication Data

US 2017/0004959 A1 Jan. 5, 2017

(51) Int. Cl.

| | |
|---|---|
| ***H01J 49/00*** | (2006.01) |
| ***H01J 49/04*** | (2006.01) |
| ***H01J 49/16*** | (2006.01) |

(52) U.S. Cl.
CPC ..... *H01J 49/0463* (2013.01); *H01J 49/167* (2013.01)

(58) Field of Classification Search
USPC ..... 250/281, 282, 288
See application file for complete search history.

(56) References Cited

U.S. PATENT DOCUMENTS

2013/0015345 A1* 1/2013 Vertes ..... H01J 49/0404 250/282

* cited by examiner

*Primary Examiner* — Nicole Ippolito
*Assistant Examiner* — Hanway Chang
(74) *Attorney, Agent, or Firm* — Michelle Chew Wong; Lawrence Berkeley National Laboratory

(57) ABSTRACT

A new experimental setup for spatially resolved ambient infrared laser ablation mass spectrometry (AIRLAB-MS) that uses an infrared microscope with an infinity-corrected reflective objective and a continuous flow solvent probe coupled to a Fourier transform ion cyclotron resonance mass spectrometer is described. The efficiency of material transfer from the sample to the electrospray ionization emitter was determined using glycerol/methanol droplets containing 1 mM nicotine and is ~50%. This transfer efficiency is significantly higher than values reported for similar techniques.

6 Claims, 9 Drawing Sheets

AMBIENT INFRARED LASER ABLATION MASS SPECTROMETRY (AIRLAB-MS) WITH PLUME CAPTURE BY CONTINUOUS FLOW SOLVENT PROBE

STATEMENT OF GOVERNMENTAL SUPPORT

This invention was made with government support under Contract No. DE-AC02-05CH11231 awarded by the U.S. Department of Energy and under Grant CHE-1306720 awarded by the National Science Foundation. The government has certain rights in the invention.

CROSS-REFERENCE TO RELATED APPLICATIONS

This application claims priority to and is a non-provisional application of U.S. Provisional Patent Application No. 62/012,402, filed on Jun. 15, 2014, hereby incorporated by reference in its entirety.

BACKGROUND OF THE INVENTION

Field of the Invention

The present invention relates to the fields of laser ablation and mass spectrometry. The present invention also relates specifically to methods and devices for plume capture of laser ablated samples for mass spectrometry and spectroscopy.

Related Art

Determining the chemical composition of complex biological systems, such as tissues, biofilms, and bacterial colonies, presents a daunting analytical challenge. The composition of such samples are typically heterogeneous and dynamic, changing both in time and in response to varying environmental conditions, requiring methods of analysis that can provide chemical information with both high spatial and temporal resolution. The ability to measure and image the chemical composition of biological samples under native conditions and with minimal modification/preparation is important to advancing our understanding of processes, such as cell differentiation,[1-3] photosynthesis[4-5] and cellular metabolism.[6-9].

There are many microanalysis techniques for characterizing the chemical composition of biological samples, including NMR/MRI,[10-11] visible microscopy, infrared spectromicroscopy,[1, 6-8] Raman imaging,[12-13] fluorescence-tagging and imaging of molecules,[14-15] and imaging mass spectrometry.[16-30] (See References 14-20), Many of these techniques can provide high spatial resolution and are non-destructive, but often do not provide unambiguous chemical information. Fluorescence-tagging of molecules can provide images with both very high spatial resolution (~1-200 nm) and precise molecular specificity by using antibodies to target specific molecules. However, only a few components can be imaged simultaneously through the use of fluorophores with different emission wavelengths, and the procedure for tagging molecules with fluorophores often requires extensive sample preparation. Imaging mass spectrometry provides chemical information with excellent molecular specificity and can be used to generate images for up to thousands of compounds measured simultaneously.[30] Mass spectrometry can also be combined with other imaging techniques to provide multimodal imaging analysis.[31-34] Unlike many optical methods, mass spectrometry is a destructive technique; molecules must be removed from the sample and be ionized to be detected.

The most widely-used mass spectrometry imaging techniques are matrix-assisted laser desorption ionization (MALDI)[16-19, 22-23, 30]_ and secondary ion mass spectrometry (SIMS).[16-21] Conventional MALDI and SIMS are often used to generate chemical images for fixed tissue samples. For both techniques, ions are generated under vacuum and are subsequently mass analyzed. Because vacuum is required for these techniques, neither is suitable for the analysis of living systems. MALDI typically involves the application of an external and usually denaturing matrix chemical which absorbs the energy from a laser resulting in ablation and ionization. With SIMS, secondary ions are sputtered off a surface with a beam of primary ions, such as $Cs^+$ or polyatomic $Au_n^+$ clusters. Chemical images can be obtained with very high spatial resolution (~100 nm),[20] but the sensitivity for high mass ions (m/z>1000) can be poor due to low secondary ion yields.[18-21, 35].

Many techniques for imaging mass spectrometry at ambient pressure have been recently introduced. Cooks and co-workers introduced a now widely used method, desorption electrospray ionization (DESI), in 2004.[28] With DESI, a plume of charged solvent droplets generated by electrospray is directed at a sample surface and the charged droplets desorb and ionize chemical components from the sample surface. Many other ambient imaging mass spectrometry techniques have subsequently been developed. With nano-DESI[36-37] and liquid micro-junction surface sampling probe (LMJ-SSP),[38-40] solvent is flowed over a small area of sample and then carried to an ESI emitter. Numerous methods use laser light to select spatially resolved areas for mass analysis. These methods include electrospray-assisted laser desorption ionization (ELDI),[41-42] atmospheric pressure infrared MALDI (AP IR-MALDI),[43-44]_matrix-assisted laser desorption electrospray ionization (MALDESI),[29, 45-46]_laser ablation electrospray ionization (LAESI),[26, 47] and IR laser ablation sample transfer (LAST).[24-25, 27, 48-49]

Methods that use IR-laser ablation can take advantage of the water naturally present in biological samples as a matrix to absorb IR radiation. The IR laser pulse produces surface evaporation, phase explosion (explosive boiling) of water and the secondary ejection of sample material into a plume of fine droplets.[50-51] The ejected sample material consists of mostly neutral droplets/particles which can be ionized by intersection with an electrospray plume (ELDI, LAESI, MALDESI) or can be captured in solvent (LAST) for subsequent ionization by electrospray. With AP IR-MALDI, the fraction of molecules directly ionized by the laser ablation process are introduced into the mass spectrometer. The energy deposited into solute molecules by the laser ablation process has been studied using thermometer ions with well known fragmentation energies (i.e. benzyl-substituted benzylpyridinium salts), and with peptides (i.e. bradykinin, substance P). Water/methanol solutions of these compounds were air-dried onto plant leaves and laser ablated with energy densities of up to 15 J/cm$^2$. Based on comparison of the fragmentation product intensities measured for LAESI and ESI experiments under varying fragmentation conditions, the infrared laser ablation was reported to have little effect on the internal energy distribution of the resulting ions for laser energy densities up to 15 J/cm$^2$.[51]

High transfer efficiency is especially important for the analysis of biological samples due to low concentrations of some molecular species within the highly complex mixtures of biochemicals from living cells. The transfer efficiency from a 1 mM solution of angiotensin II to flowing solvent by backside geometry laser ablation was reported to be 2%.[25]

This value was estimated by comparing the signal obtained from the laser ablation of a known quantity of angiotensin II with the signal obtained from direct electrospray ionization of an angiotensin II standard solution. LAESI, in which the ablation plume expands into a flow of highly charged solvent droplets produced by electrospray, is reported to be "characterized by significant sample losses and low ionization efficiencies."[26] Vertes and co-workers reported that the transfer efficiency of LAESI was improved by the use of a capillary to confine the sample and to direct the radial expansion of the ablation plume, guiding more material directly into the electrospray flow and described in Stolee, J. A.; Vertes, A., Toward Single-Cell Analysis by Plume Collimation in Laser Ablation Electrospray Ionization Mass Spectrometry. *Anal. Chem.* 2013, 85, 3592-3598, hereby incorporated by reference.[26]

BRIEF SUMMARY OF THE INVENTION

A system for spatially resolved ambient infrared laser ablation mass spectrometry (AIRLAB-MS) that uses an infrared microscope with an infinity-corrected reflective objective and a continuous flow solvent probe coupled to a Fourier transform ion cyclotron resonance mass spectrometer is described. The efficiency of material transfer from the sample to the electrospray ionization emitter was determined using glycerol/methanol droplets containing 1 mM nicotine and is ~50%. This transfer efficiency is significantly higher than values reported for similar techniques. No fragmentation of biomolecules was observed with droplets containing bradykinin, leucine enkephalin and myoglobin, except loss of the heme group from myoglobin as a result of the denaturing solution used.

An application of AIRLAB-MS to biological materials is demonstrated for tobacco leaves. Chemical components are identified from the spatially resolved mass spectra of the ablated plant material including nicotine and uridine. The reproducibility of measurements made using AIRLAB-MS on plant material was demonstrated by the ablation of six closely spaced areas (within 2×2 $mm^2$) on a young tobacco leaf and the results indicate a standard deviation of <10% in the uridine signal obtained for each area. The spatial distribution of nicotine was measured for selected leaf areas and variation in the relative nicotine levels (15-100%) was observed. Comparative analysis of the nicotine distribution was demonstrated for two tobacco plant varieties, a genetically modified plant and its corresponding wild-type indicating generally higher nicotine levels in the mutant.

DETAILED DESCRIPTION OF THE PREFERRED EMBODIMENT

Introduction

Figure 1A:
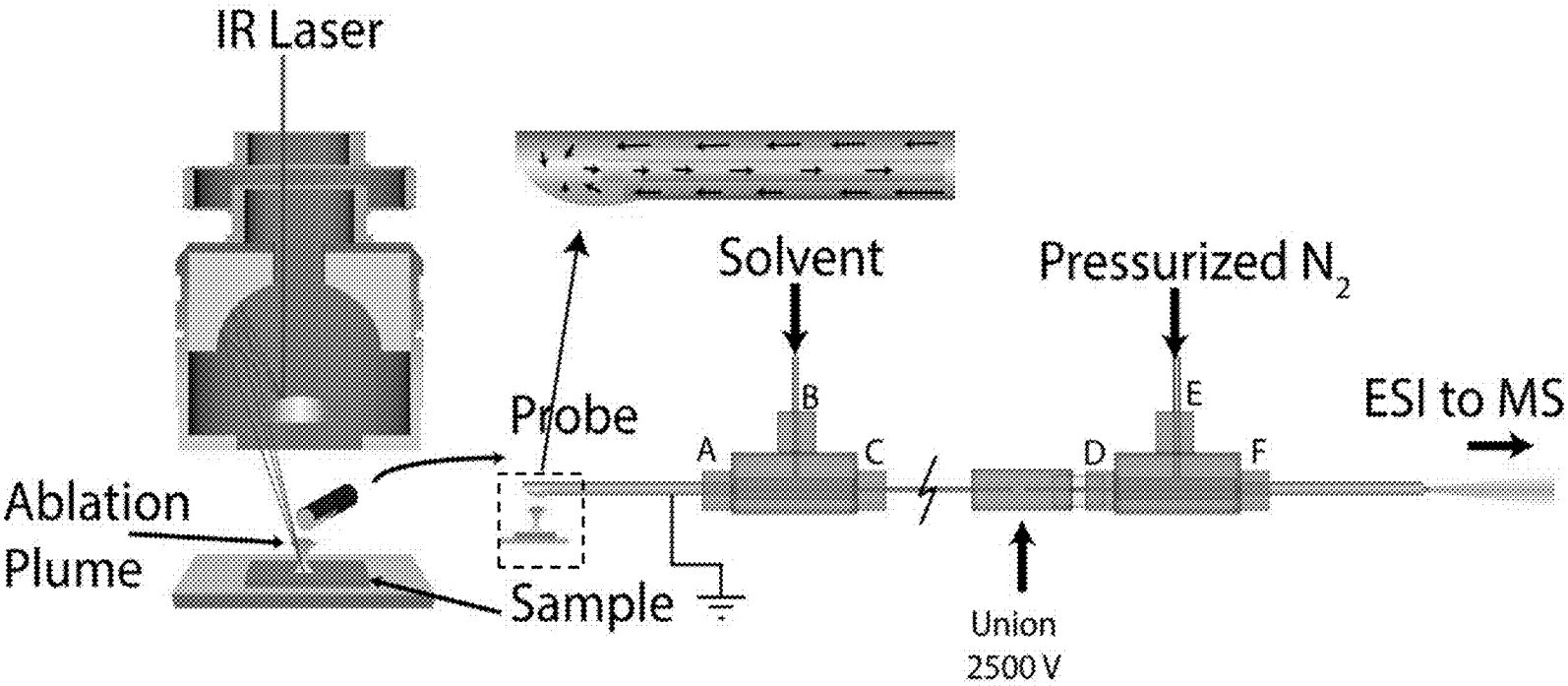
FIG. 1A is a schematic diagram (not to scale) of the AIRLAB-MS experimental setup. The IR laser is focused through a 15× reflecting objective mounted on a Continuum XL infrared microscope. The ablation plume is captured by a droplet at the tip of a stainless steel capillary attached to a PEEK tee fitting (port A). Solvent is pumped with a syringe pump into port B. A fused silica capillary carries solvent and ablated material from the probe tip (enlarged to show solvent flow) out through port C and to the electrospray emitter. A stainless steel union (attached to port D) is used to apply the electrospray voltage to the solution. Regulated $N_2$ enters the PEEK emitter tee fitting at port E and a fused silica capillary carries solvent and sample from the union, through the tee, and out port F where ions are generated by pneumatically assisted electrospray ionization.

Ambient mass spectrometry (MS) imaging of live cells under ambient conditions can provide insight into biological processes such as cell differentiation and photosynthesis. Imaging MS techniques that use IR laser ablation take advantage of the water naturally present in biological samples as a matrix to absorb IR radiation. Explosive boiling of the water ejects sample material into a plume of fine droplets. See Apitz, I.; Vogel, A., Appl. Phys. A-Mater. Sci. Process. 2005, 81, 329-338. These mostly neutral droplets can be ionized by intersection with an electrospray plume (ELDI (Shiea, J., et al., Rapid Commun. Mass Spectrom. 2005, 19, 3701-3704), LAESI (Stolee, J. A.; Vertes, A., Anal. Chem. 2013, 85, 3592-3598), MALDESI (Sampson, J. S.; Hawkridge, A. M.; Muddiman, D. C., J. Am. Soc. Mass Spectrom. 2006, 17, 1712-1716)) or captured in solvent for ionization by electrospray (Park, S. G.; Murray, K. K., Rapid Commun. Mass Spectrom. 2013, 27, 1673-1680.; Ovchinnikova, 0. S.; Kertesz, V.; Van Berkel, G. J., Anal. Chem. 2011, 83, 1874-1878). High transfer efficiency is important for the analysis of biological samples due to low concentrations of some molecular species, but existing techniques report low (~2%) transfer efficiency and "significant sample losses and low ionization efficiencies." (Stolee, J. A.; Vertes, A., Anal. Chem. 2013, 85, 3592-3598). The present system overcomes these problems and reports a significant transfer efficiency of ~50%.

Descriptions of the Embodiments

Herein we describe a new system and experimental setup for ambient infrared (IR) laser ablation mass spectrometry (AIRLAB-MS) comprising a laser, an infrared microscope with a reflecting objective and a continuous flow solvent probe coupled to a mass spectrometer and/or mass analyzer. This system has the advantage of high transfer efficiency (~50%) and provides measurements with high reproducibility from samples such as biological materials with a standard deviation <10%.

The laser can be any pulsed infrared (IR) laser that is tuned to absorption bound water such that any place where the laser is focused and any sample having water is vaporized upon laser emittance, the sample is ablated and expelled upward like a plume. In one embodiment, the IR laser is emitting 2.94 μm light which corresponds to the peak of water absorption, and the laser spot size is ~60 μm corresponding to energy density of 5.3 J/cm$^2$.

The continuous flow probe is assembled and fitted to connect to the electrospray emitter. In some embodiments, the probe having an outer diameter (OD), and inner diameter (ID) capillary is connected such that solvent from a pump is continuously flowed to the tip of the probe in the outer diameter of the probe and captures the ablated sample plume after ablation into the inner diameter of the probe, transferring the sample to the mass spectrometry emitter. In some embodiments, the capillary is notched at the tip of the probe (See FIGS. 1A and 1B) allowing a solvent drop to be exposed to capture the ablated sample.

In one embodiment, the system comprising an infinity-corrected reflective objective which allows the laser to be focused directly under probe droplet.

In some embodiments, the probe is positioned above the sample surface. In one embodiment, the probe is positioned about 1-5 mm, about 2-4 mm, and in some embodiments about 2 mm above the sample.

The solvent flow rate is adjusted to match the electrospray flow rate by observing any changes in the size of the solvent droplet at the tip of the probe. A small droplet (e.g., ~0.6 mm radius) is maintained at the tip of the probe until laser ablation occurs. Directly after a laser ablation event, the flow is stopped until the droplet is aspirated into the capillary, which may take a few seconds (e.g., ~4-8 s) to minimize dilution of the sample. The solvent flow rate is subsequently increased until another small droplet is formed.

In some embodiments, the probe is further connected through a multi-port or T-shaped connector to a syringe pump and typically operated at flow rates of 20-30 μL/min. In some embodiments, the probe is a fused silica capillary having an outer and inner diameter that extends through the T-shaped connector and into the stainless steel capillary up to the notch and the other end exits the probe and attached to the electrospray emitter. In one embodiment, the outer diameter of the capillary is made of stainless steel or other metal, and the inner diameter of the capillary comprised of fused silica.

In other embodiments, the system further comprising methods embodied in computer-generated and/or computer-controlled scripts which combine and automate the position of the motion control stage and on/off control of the laser. In other embodiments, the pump or solvent flow is further controlled. In some embodiments, such control can be manual or automated control through actuator or computer control.

In various embodiments, after the sample is subjected to a laser ablation to create a discrete plume of fine droplets which are collected through the probe and transferred to a mass analyzer or mass spectrometer. Mass spectra are collected using a mass spectrometer and analyzed using any means of mass spectrometry analysis tools known in the art.

In some embodiments, the continuous flow probe directs the captured molecules into a mass analyzer or detector, and other instrument modalities that include but are not limited to time-of-flight (TOF), ion trap (Orbitrap), Fourier-transform ion cyclotron (FTIR), magnetic sector, quadrupole, or other mass spectrometers. In one embodiment, the ions that result either from direct desorption/ionization or subsequent ionization/fragmentation processing of the sample are analyzed to separate or measure the mass to charge ratio for the ions and the abundance of these ions. There are a wide range of mass analyzers that can be used. Instrument modalities that can be used include but are not limited to time-of-flight (TOF), ion trap (Orbitrap), Fourier-transform ion cyclotron (FT/ICR), magnetic sector, quadrupole, or other mass analyzers and combinations of mass analyzers. In a preferred embodiment, FT/ICR and tandem mass spectrometers (MS/MS) are used.

In other embodiments, visible microscopy, IR spectromicroscopy and spatially resolved mass spectrometry are integrated into the system. In various embodiments, the system further comprises detectors and an additional light source for conducting visible and/or infrared spectromicroscopy. In some embodiments, the light source emits in the mid-infrared range. In other embodiments, the detector detects infrared reflectance or transmitted light.

Thus, in various embodiments, prior to laser ablation of the sample, IR spectromicroscopy and/or visible microscopy is conducted on the sample area. In various embodiments, IR reflectance spectroscopy can be carried out as described in Probst A J, Holman H Y, DeSantis T Z, Andersen G L, Birarda G, Bechtel H A, Piceno Y M, Sonnleitner M, Venkateswaran K, Moissl-Eichinger C., "Tackling the minority: sulfate-reducing bacteria in an archaea-dominated subsurface biofilm," *ISME J.* 2013 March; 7(3):635-51doi: 10.1038/ismej. 2012.133. Epub 2012 Nov. 22; Holman H Y, Bechtel H A, Hao Z, Martin M C, "Synchrotron IR spectromicroscopy: chemistry of living cells," *Anal Chem.* 2010 Nov. 1; 82(21):8757-65. doi: 10.1021/ac100991d. Epub 2010 Sep. 14; Chen L, Holman H Y, Hao Z, Bechtel H A, Martin M C, Wu C, Chu S, "Synchrotron infrared measurements of protein phosphorylation in living single PC12 cells during neuronal differentiation," *Anal Chem.* 2012 May 1; 84(9):4118-25. doi: 10.1021/ac300308x. Epub 2012 Apr. 18, all of which are hereby incorporated by reference in their entirety.

The present systems and methods for ambient infrared (IR) laser ablation mass spectrometry (AIRLAB-MS) may be carried out on any biological or other sample wherein the water content of the sample may be used as a matrix to absorb IR radiation for ablation of the sample. In some embodiments, the sample can be biological materials including but not limited to organic matter or samples, plant materials including leaves, stem, roots or petals, etc., and including organism tissue or materials from microbial organisms and communities, prokaryiotic or eukaryotic organisms, tissue samples, cells, matrix, or metabolites, etc.

The present system and methods for AIRLAB-MS does not require any sample preparation. The application of AIRLAB-MS to tobacco leaf samples is demonstrated herein in the Examples. Spatially resolved mass spectra for the leaves of a genetically modified tobacco plant variety and its corresponding wild-type were measured and the spatial distribution of nicotine is compared for selected leaf areas.

Example 1

Laser Ablation Mass Spectrometry

Laser Ablation Mass Spectrometry.

The ambient infrared laser ablation mass spectrometry (AIRLAB-MS) instrumentation consists of four major components; an Opolette tunable infrared laser (Opotek, Carlsbad, Calif.), a Continuum XL infrared microscope (Thermo-Fisher, Waltham, Mass.) with a reflecting objective, a home-built continuous flow probe and electrospray ionization (ESI) emitter, and a home-built 7 T FT/ICR mass spectrometer. A schematic diagram of the experimental setup that includes the reflecting objective, continuous flow probe and ESI emitter is shown in FIG. 1A.

The infrared microscope is equipped with a 15× reflecting objective which is used to focus 2.94 μm light from the IR laser. The power of the laser at the sample stage is 12 mW, measured over 30 s with a pulse repetition rate of 20 Hz. The laser spot, estimated from burn marks on photographic paper, is circular with a diameter of ~60 μm corresponding to an energy density of 5.3 J/cm$^2$ per laser pulse. Samples for laser ablation were typically affixed with double-sided tape to glass microscope slides. The sample position is controlled by a motorized x,y,z translational stage and the sample can be imaged with a visible-light camera. Both the stage and camera are controlled by the Omnic (Thermo-Scientific, Waltham, Mass.) software package. Matlab (Mathworks, Natick, Mass.) scripts are used to combine and automate control of the sample position and on/off control of the laser.

Figure 1B:
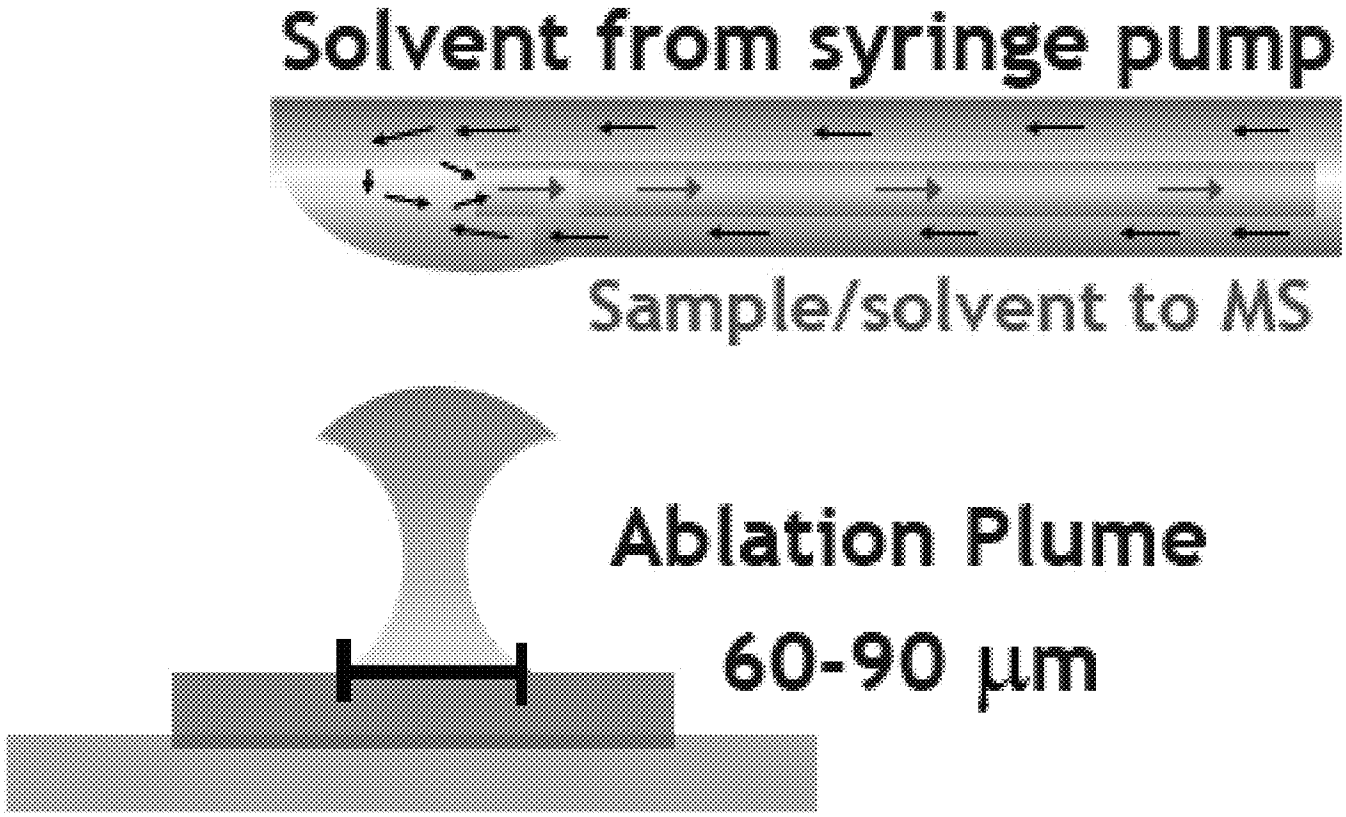
FIG. 1B is a enlargement of the continuous flow probe and sample plume shown in the dashed box of FIG. 1A.

The continuous flow probe is assembled on a PEEK tee fitting (ports A, B, C). A 1/16" outer diameter (OD), and inner diameter (ID) stainless steel capillary is connected to port A. This capillary is 8.25 cm long and is notched 0.8 mm deep and 1 mm long at the tip of the probe (FIGS. 1A and 1B). Port B is connected to a syringe pump (Harvard Apparatus, Holliston, Mass.), typically operated at flow rates of 20-30 μL/min. A 250 μm OD, 150 μm ID fused silica capillary extends through the tee and into the stainless steel capillary up to the notch and the other end exits the probe at port C and is attached to the ESI emitter.

The ESI emitter consists of a stainless steel union and a second PEEK tee fitting (ports D, E, F). The union connects the fused silica capillaries (same OD/ID) of the continuous flow probe and the ESI emitter. An electrospray voltage of ~2500 V relative to the entrance capillary of the ESI interface of the mass spectrometer is applied to the stainless steel union which is in contact with the solution. A copper grounding line is connected from the probe capillary to instrument ground in order to prevent buildup of charge at the exposed liquid surface of the probe. Sample and solvent enters the tee at port D inside a fused silica capillary which goes through a 750 μm OD, 500 μm ID stainless steel capillary attached to port F and ends 0.5 mm beyond the end of the stainless steel capillary. Port E is connecting to a regulated flow of $N_2$ gas, typically maintained at 36 PSI. The pneumatically-assisted electrospray capillary is positioned approximately 1 cm away from the entrance capillary of the mass spectrometer and at an angle of ~30° from perpendicular to the capillary axis.

The position of the probe is controlled by manual x,y,z stages and is set so that the center of the probe notch is positioned directly above the laser focus as visualized with a HeNe laser that is co-linear with the infrared beam. The syringe pump flow rate is adjusted to match the electrospray flow rate by observing any changes in the size of the solvent droplet at the tip of the probe. A small droplet (~0.6 mm radius) is maintained at the tip of the probe until laser ablation occurs. Directly after a laser ablation event, the syringe pump is stopped until the droplet is aspirated into the fused silica capillary (4-8 s) to help minimize dilution of the sample. The solvent flow rate is subsequently increased until another small droplet is formed.

The FT/ICR mass spectrometer is based on a 2.75 T described in detail previously in Bush, M. F., et al., Infrared spectroscopy of cationized arginine in the gas phase: Direct evidence for the transition from nonzwitterionic to zwitterionic structure. *J. Am. Chem. Soc.* 2007, 129, 1612-1622, hereby incorporated by reference,[52] but with a higher field 7 T magnet and a modified vacuum chamber. Briefly, positive ions are generated by electrospray and are guided through five stages of differential pumping to an ion cell. Ions are accumulated for 6 s and a pulse of dry nitrogen gas (~$10^{-6}$ Torr) is used to enhance ion trapping. After a 7 s delay, the ion cell pressure returns to <$10^{-8}$ Torr before ion excitation and detection. During ablation experiments, mass spectra are acquired every 16 s and stored individually. The reported ion abundances are relative to the abundance measured for leucine enkephalin which was included in the solvent flow solution at a concentration of 2.5 μM. Using leucine enkephalin as an internal standard helps minimize effects of any differences in electrospray conditions or solvent flow rate and enables more comparable measurements of ion abundances for experiments performed on different samples/days.

A nicotine standard (1 mg/ml) in methanol, leucine enkephalin, bradykinin, apo-myoglobin and glycerol were obtained from Sigma-Aldrich (St. Louis, Mo.). HPLC grade methanol, acetonitrile, and glacial acetic acid were purchased from Fisher Scientific (Pittsburgh, Pa.) and ultrapure water (>18MΩ) was used.

Solvent Extraction of Tobacco Plants and Analysis.

Samples from four tobacco (*Nicotiana tabacum*) plant varieties, Petite Havana (P H), John Williams (J W), Glurk (Glu), and a truncated light antenna (TLA) mutant of the John Williams variety were prepared by weighing each leaf (ranging from 0.39 g for Glu to 0.60 g for J W), flash freezing with liquid nitrogen and powdering using a mortar and pestle. The powdered plant material was transferred into 20 mL of acetonitrile followed by 30 mins of ultrasonication in a room temperature bath and then storage at 4° C. for 24 hrs. The solutions were centrifuged at 7000 g for 10 mins and the supernatant was extracted to minimize the amount of solid plant material in the solutions. Mass spectra of these solutions were acquired using a Waters Quadrupole-Time-of-Flight (Q-TOF) Premier mass spectrometer (Waters, Milford, Mass.) in positive ion mode. A solution of pure acetonitrile was processed in the same manner as the plant extracts and a mass spectrum of this solution was acquired to provide a measure of the background/contaminate signals. The mass spectra reported for the plant extracts are background subtracted.

Results and Discussion

Transfer Efficiency of Ablated Samples.

The efficiency of transferring sample from a surface to the ESI emitter was determined by IR laser ablation of droplets containing 1 mM nicotine in ~85/15 glycerol/methanol solution. Glycerol was chosen as a matrix because it does not readily evaporate under ambient conditions and strongly absorbs IR light at 2.94 μm wavelength (~5% transmittance). The transfer efficiency (defined here as the moles detected/moles ablated×100%) requires measurement of the volume of material ablated by each laser shot. The droplets were deposited on Teflon tape attached to a glass microscope slide. The tape was used because the droplets formed consistent, spherical shapes on the Teflon instead of variable diameter shapes which formed for sample deposition on glass. The ablation volume per laser shot was determined by the number of laser shots required to completely ablate a 1 μL droplet of the glycerol/methanol solution. This value is 1000±200 laser shots and was measured using sets of 50 consecutive laser shots (2.5 s) and a 30 s delay between each set to reduce effects of droplet heating. These results indicate that 1.0±0.2 nL of solution, which contain ~$1\times10^{-12}$ moles of nicotine are ablated per laser shot.

Figure 2:
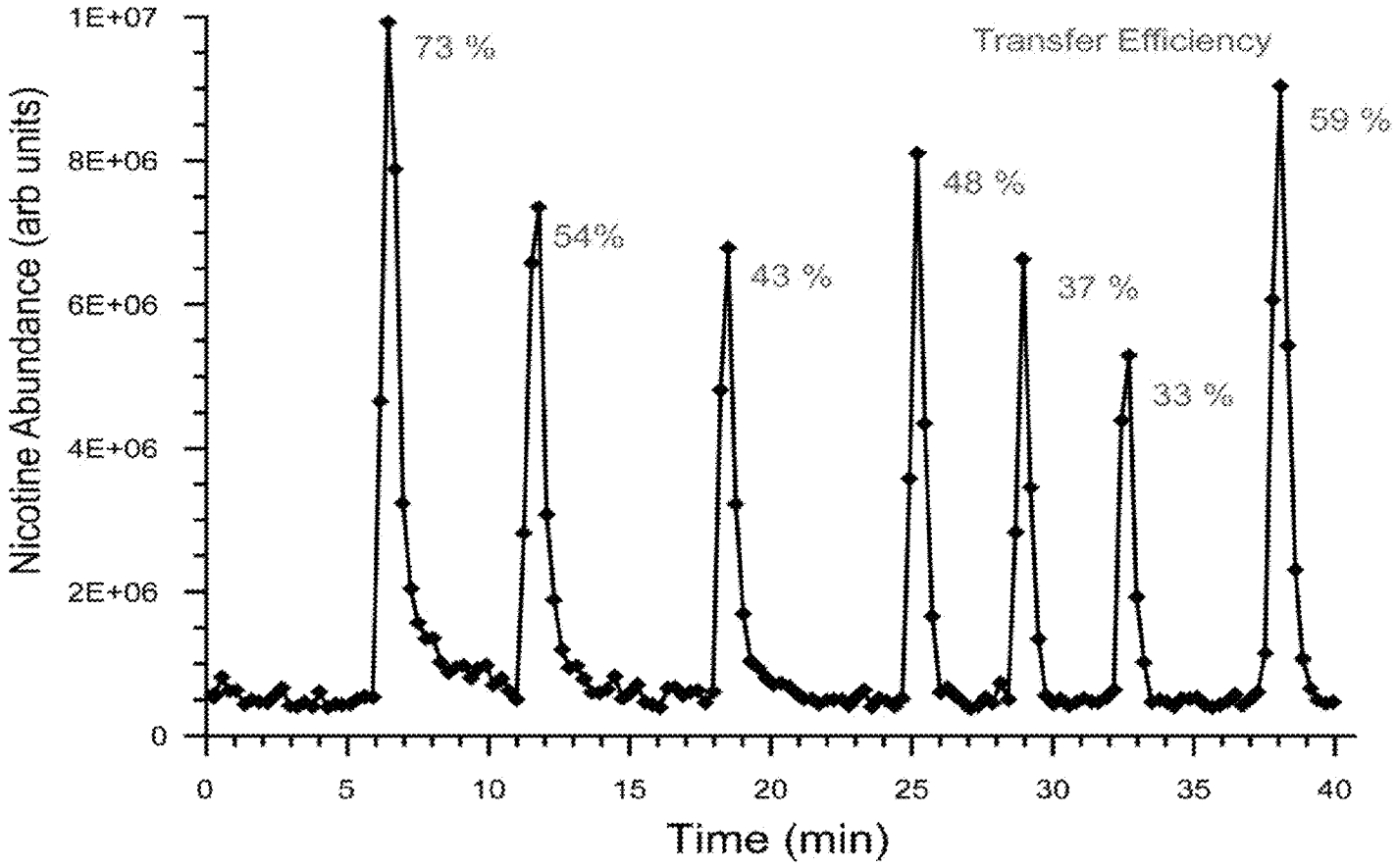
FIG. 2. Ion abundance as a function of time for protonated nicotine measured by laser ablation from a 10 μL droplet of 85/15 glycerol/methanol containing 1 mM nicotine. Sets of 10 laser pulses were used to ablate sample material. The transfer efficiency, defined as moles detected/moles ablated, is labeled next to its corresponding peak.

The transfer efficiency was determined by measuring the ion abundances from mass spectra obtained by for laser ablation of a nicotine containing droplet and by ESI of a standard solution containing nicotine. A 10 μL droplet was used in these experiments because it provides a flatter surface resulting in reproducible ion generation. Ion signal for protonated nicotine was monitored during the experiment and bursts of 10 laser shots were used to ablate the sample. The ion abundance as a function of time for protonated nicotine shows spikes for each set of 10 laser shots (FIG. 2). The time between the laser shots and the appearance of nicotine signal is ~90 s and the signal is observed for ~60-75 s. The area under the each spike in the nicotine signal was integrated and scaled to account for the 10 s of each measurement cycle during which ions were not accumulated and measure with the mass spectrometer. These corrected areas indicate the total amount of nicotine signal produced from each set of 10 laser shots. The measured areas are converted to mole equivalents based on a calibration curve obtained under the same experimental conditions using nicotine standards in the same solvent as used with the continuous flow probe (1:1 $H_2O$:MeOH 1% acetic acid). The transfer efficiency, defined as (moles detected/moles ablated×100%), was determined for each set of 10 laser pulses and is labeled for each peak in FIG. 2. The average transfer efficiency for these 7 measurements is ~50±14%. The variability in the transfer efficiency is likely due to environmental/sample variations, such as bubble formation. Bubbles were occasionally observed on the surface of the droplet after laser ablation and may change the ablation plume formation and direction. Reproducibility experiments on plant tissue were also performed and are discussed below.

The transfer efficiencies obtained using AIRLAB-MS are significantly higher than those reported for other laser ablation-mass spectrometry techniques. Murray and co-workers reported that the transfer efficiency obtained in their infrared ablation experiments is 2%.[25] The transfer efficiency of LAESI has not been reported, but the technique is described as being "characterized by significant sample losses and low ionization efficiencies."[26] The high transfer efficiency obtained for the AIRLAB-MS system is likely a result of the positioning of the probe droplet which is directly above the laser focus. Unlike LAESI, which relies on the intersection of two plumes of small droplets (ablation and electrospray), this technique takes advantage of the more efficient process of capturing the ablated material into a liquid surface. In contrast with the back-side geometry of the technique used in some studies by Murray and co-workers,[24-25, 27] the laser in our system is focused on and irradiates the sample at the surface directly below the sample probe. Imaging of material ejection caused by IR laser pulses has been reported by Vogel and co-workers.[50] Their images showed the formation of ablation plumes from water surfaces with most of the material ejected directly upward from the sample surface. With a back-side geometry, the material is vaporized at the interface of the sample with the sample holder, usually an indium-tin-oxide coated quartz microscope slide. Thus, the material ejection can not form the same plume shapes as reported for front-side irradiation, which may lead to the low (2%) transfer efficiencies. An additional advantage of the AIRLAB-MS experimental setup over back-side laser desorption is the ability to analyze samples thicker than the laser penetration depth.

The unique combination of liquid surface capture and front-side irradiation is enabled by the use of a reflecting IR objective with the microscope. Instead of focusing the IR laser through a lens or fiber-optic cable which would then be blocked by the sample probe, the reflecting objective (FIG. 1) directs the laser light so that it is angled under the probe with the focal plane parallel to the sample surface. This geometry allows the liquid surface of the probe to be positioned close to the sample surface without increasing the laser spot size, which would occur for laser light focused at an angle underneath the droplet.

To determine if fragmentation of biomolecules occurs with AIRLAB-MS, mass spectra were measured for ablation of glycerol droplets containing leucine enkephalin (~555 Da), bradykinin (~1060 Da), or myoglobin (17,567 Da). No fragmentation products were observed, except for the loss of the non-covalently bound heme group from myoglobin. Apo-myoglobin was also observed for direct electrospray ionization of 1 μM myoglobin in the same solvent as used for the continuous flow probe (50/50 $H_2O$/MeOH 1% acetic acid). These results indicate that the loss of heme group is likely caused by the denaturing of the protein by the solvent. The lack of fragmentation indicates that the sample transfer by IR laser ablation with our instrumental design is sufficiently gentle to provide intact molecular ions by ESI, consistent with previous results.[51] The gentle transfer and ionization conditions indicate that this technique can be used to study a wide range of biomolecules and perhaps biomolecular complexes if native conditions are used.

Example 2

Application to Tobacco Plant Varieties and Nicotine Distribution

Chemical Composition of Tobacco Varieties.

Figure 3:
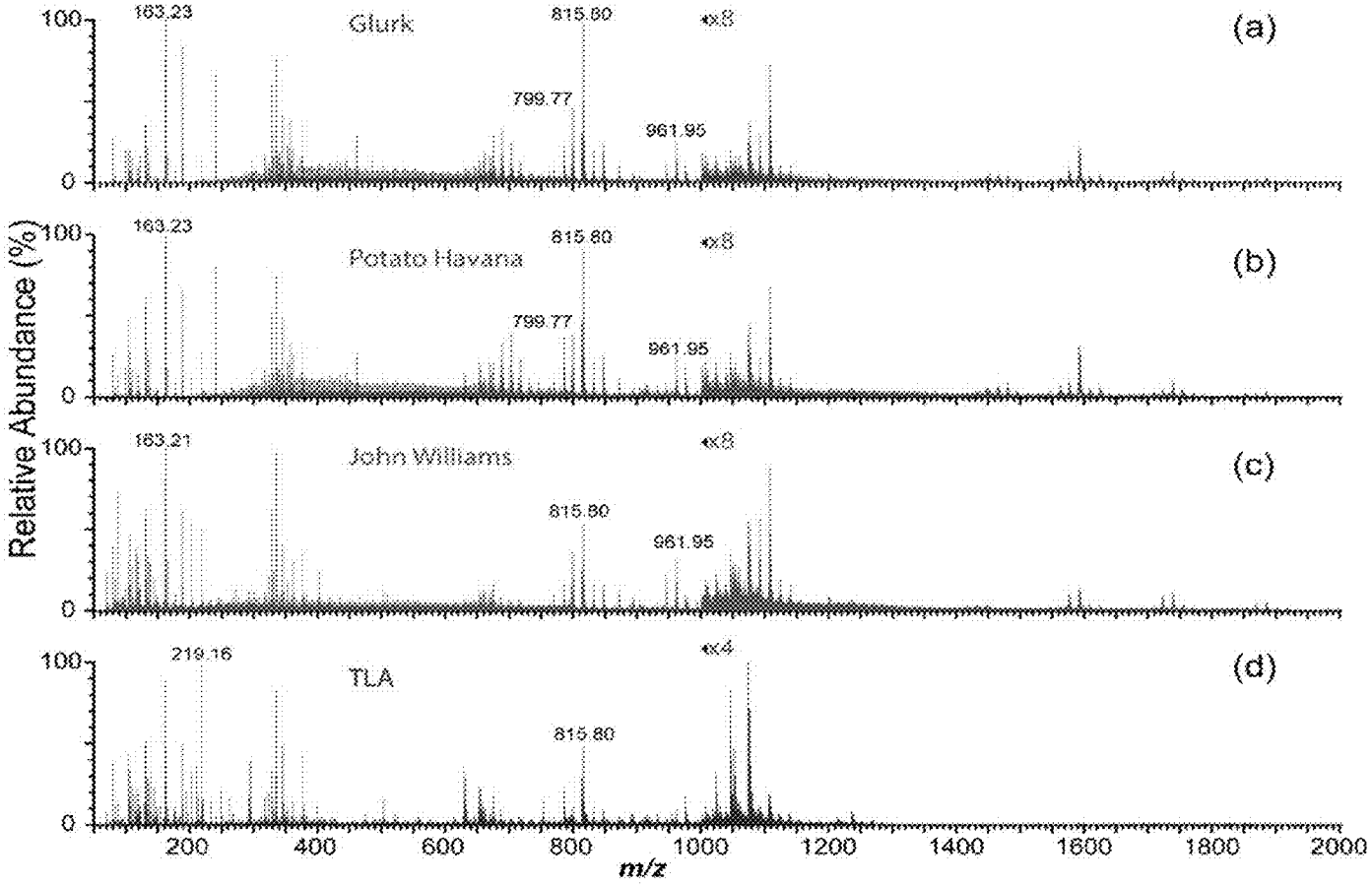
FIG. 3. Positive ion nanospray mass spectra of tobacco leaf extracts in acetonitrile from four plant varieties; a) Glurk, b) Petite Havana, c) John Williams, d) Truncated light antenna (TLA), a mutant variety based on the John Williams wild-type.

Four genetically different tobacco plants; Petite Havana (P H), John Williams (J W), Glurk (GluC) and John Williams variety with truncated light antenna (TLA) plants were cultivated and the chemical composition of individual leaves from each plant ($4^{th}$ leaf from the top) was analyzed by solvent extraction followed by mass spectrometry. The positive ion ESI mass spectrum for each sample has ions at m/z 799.41, 815.39 and 961.44 (FIG. 3), and from comparison of the measured masses to a tobacco plant metabolite database[53] and studies reporting extraction of these compounds from similar tobacco plants,[54] these ions are identified as diterpene glycosides, Lyciumoside IV, II and VII, respectively. These ions are significantly more abundant for GluC and P H than for J W and TLA. There is a distribution of ions from m/z ~690-710 in the mass spectra for GluC and P H with slight differences in the relative ion abundances, but these varieties are the most similar. These ions are significantly less abundant for J W and TLA. The mass spectrum of TLA shows the greatest chemical differences in the relative abundances of the ion at m/z 219.16 and of ions in the range of m/z 1000-1150. The J W and TLA plants were selected for laser ablation experiments because J W is the corresponding wild-type variety of the TLA mutant and the mass spectra for the whole leaf extracts show differences in their chemical composition.

Reproducibility of Ablation from Plant Material.

In order to characterize the reproducibility of the laser ablation transfer process for plant tissue samples, a small (~2 cm diameter) leaf from a tobacco seedling was used as a sample. The young plant leaf was selected to minimize variations in the leaf tissue due to vasculature (leaf veins) and trichomes (small hairs) both of which are more prevalent in mature leaves. The smaller leaf is also more flexible and adheres readily to the microscope slide. The AIRLAB-MS system was programmed to ablate an area of ~360 μm by 360 μm by moving the sample through a 4×4 grid of positions separated by 90 μm. A laser pulse frequency of 5 Hz was used corresponding to ~375 total laser shots. Typically, plant material for a given spot was ablated within 3 laser shots, requiring effectively ~48 laser shots. However, to better ablate thicker plant material and to ensure the entire target area was ablated, 375 shots were used. Six closely spaced areas (within 2×2 mm) were ablated.

Figure 4:
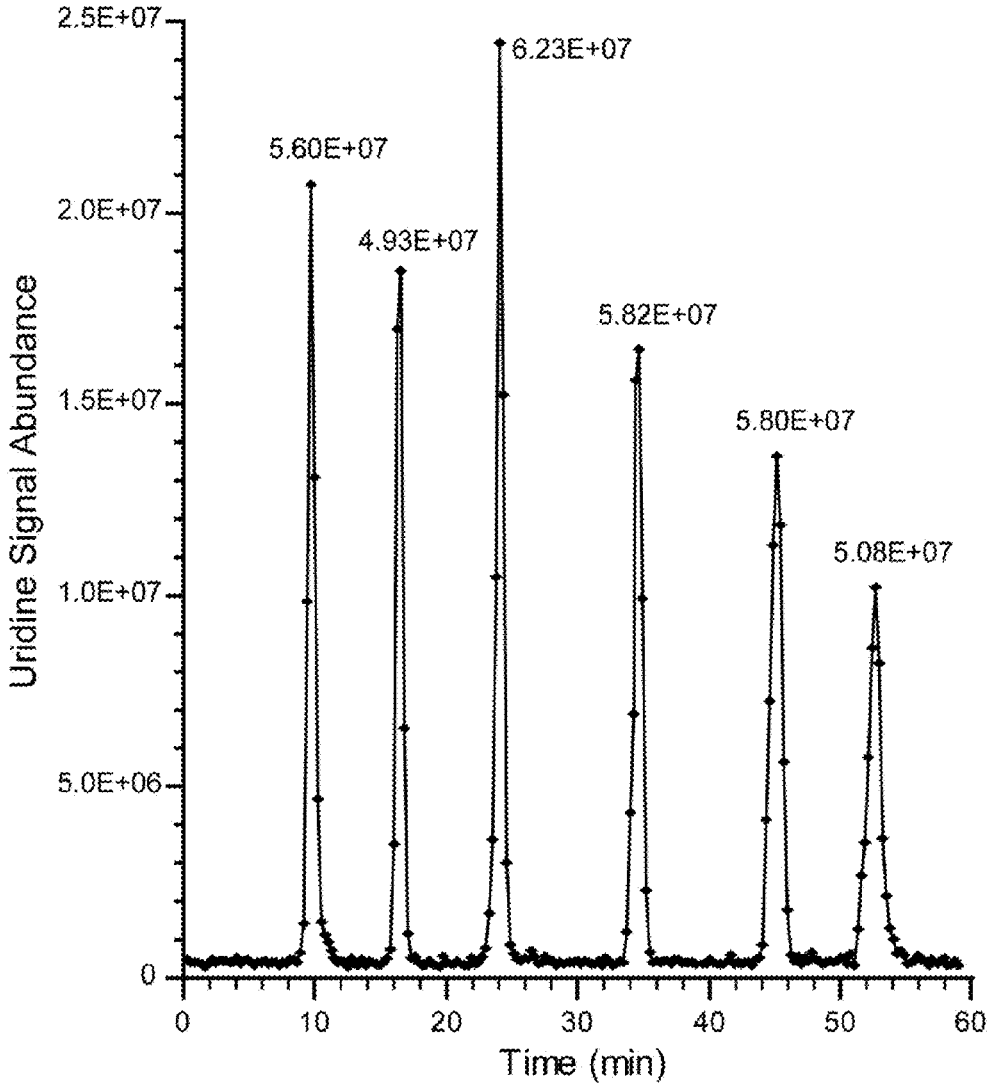
FIG. 4. Ion abundance as a function of time for protonated uridine obtained by laser ablation from a leaf from a tobacco seedling. Six 360×360 μm areas were ablated individually the average integrated area was $5.48 \pm 0.45 \times 10^7$. The peak areas (arb. units) are labeled.

The most abundant ion (m/z 245.081) in the mass spectra of the young leaf is likely protonated uridine based on its exact mass and comparison of this mass to a database of tobacco plant metabolites. The abundance of protonated uridine resulting from these experiments as a function of time is shown in FIG. 4 (integrated areas for each peak are labeled). The experimental conditions, including probe height, droplet size and solvent flow rate were kept as similar as possible. The average peak area is $5.48\pm0.45\times10^7$ (arb. units) indicating a standard deviation of less than 10% in the uridine signal over six experiments. The variability in the signal includes contributions from the measurement reproducibility as well as any spatial variability in the concentration of uridine for the areas measured. The reproducibility obtained in these experiments indicates that relative changes in the spatial distribution of compounds from plant tissue can be measured with reasonable precision.

Laser Ablation of Mature Tobacco Leaves.

Figure 5:
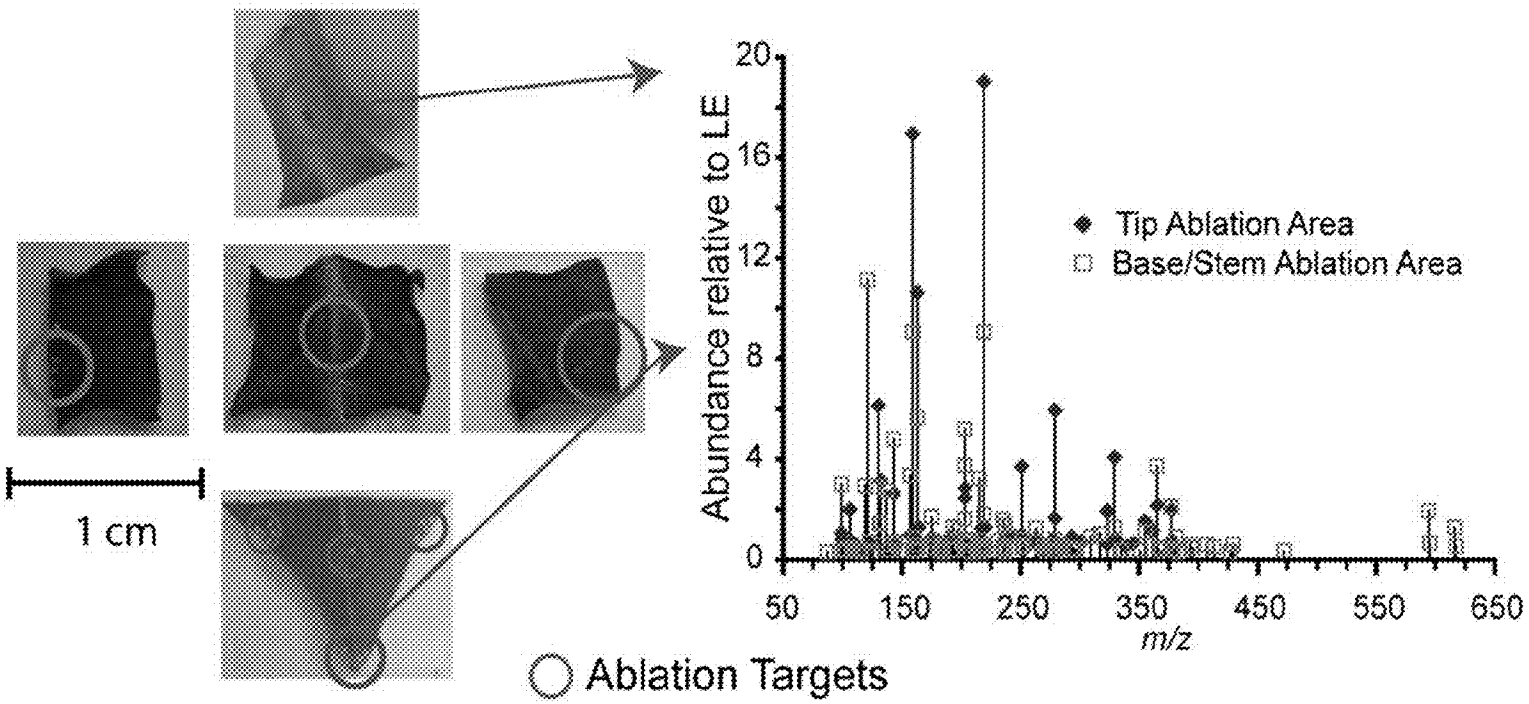
FIG. 5. Images of tobacco leaf samples from a John Williams plant and the areas selected for laser ablation indicated by circles. Representative mass spectra for the leaf tip and leaf base/stem are also shown.

For analysis of spatial variations in the chemical compositions of the John Williams and TLA tobacco leaves, eight locations were selected (indicated by circles in FIG. 5). Four locations are within 1 cm of the tip of the leaf, three are on the leaf mid-section, and one is on the stem at the base of the leaf. These locations were selected to provide a variety of plant tissue types and ages. At each location, at least three 360×360 μm ablation areas were analyzed. The same 4×4 grid programmed for the reproducibility experiments was used. The trichromes or leaf hairs were much more developed and prominent for these leaves which were more mature than that used for the reproducibility measurements. There is a greater variability in ion abundances for these more mature leaves, likely caused by the unpredictable and variable effects of the leaf hairs on the sample transfer efficiencies. Two representative mass spectra from different ablation locations are shown in FIG. 5, each consisting of the averaged intensities for the background subtracted mass spectral peaks of all mass spectra measured in the indicated areas containing a distinct peak (signal-to-noise >3) corresponding to protonated nicotine.

In total, approximately 50 ions, excluding isotope and background ions, were observed for laser ablation of the tip region and approximately 100 for the base/stem region. Of these ions, 28 were observed in both spectra. The greater number of ions for the base region may be due to the greater thickness of the stem which provides more material for transfer and thus more signal for low concentration compounds. The most abundant ions in the mass spectra of the two ablation regions are at m/z 98.986, 120.968, 163.125, 203.044, and 219.025. Based on the exact mass measurements and comparison to previous work including a tobacco plant metabolite database,[53] these ions are assigned to protonated phosphoric acid, potassiated pyrimidine-ring, protonated nicotine, sodiated hexose (most likely glucose), and potassiated hexose, respectively. The abundant ion at m/z 158.025 is consistent with multiple sodiated metabolite isomers with elemental composition ($C_5H_4N_4O$) including hypoxanthine and 8-hydroxypurine.

Figure 8:
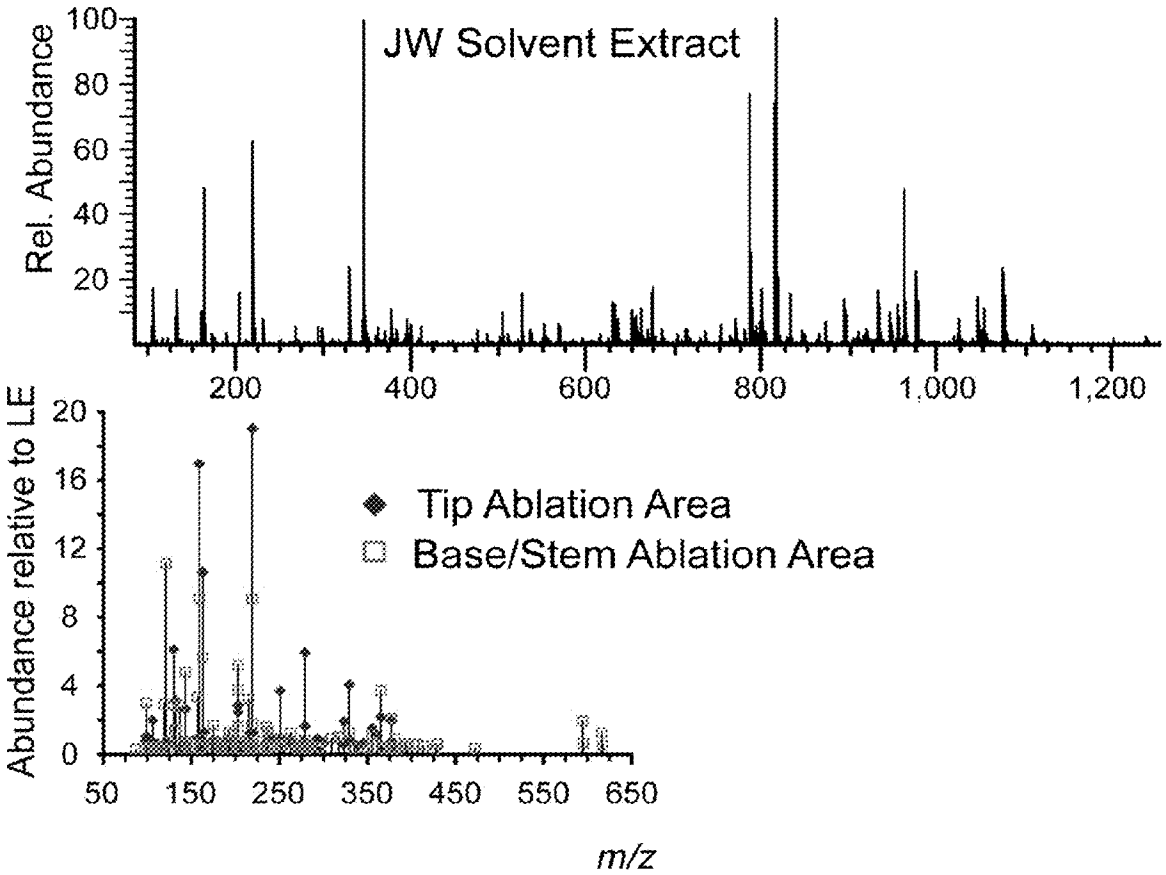
FIG. 8. To compare the ions detected using AIRLAB-MS with those obtained from solvent extraction, the extract solution for the John Williams leaf was analyzed using nano-electrospray ionization on the FT/ICR instrument with the same experimental script (accumulation time, pump-down, etc) used for laser ablation. Ion abundances from five mass spectra were averaged and their exact masses were compared with those of the ions for laser ablation of the tip and stem/base regions.

To compare the ions detected using AIRLAB-MS with those obtained from solvent extraction, the extract solution for the John Williams leaf was analyzed using nano-electrospray ionization on the FT/ICR instrument with the same experimental script (accumulation time, pumpdown, etc) used for laser ablation. Ion abundances from five mass spectra were averaged and their exact masses were compared with those of the ions for laser ablation of the tip and stem/base regions (FIG. 8). For the solvent extract, approximately 270 ions were observed with m/z ranging between 104 and 1240 and 110 of these ions were observed in the range covered for laser ablation (m/z 85-650). Approximately 30 of the ions observed for the solvent extract were also observed for laser ablation. Several of the most abundant ions for laser ablation are also abundant for the solvent extract including protonated nicotine, sodiated and potassiated hexose. However, the most abundant ion for the extract with m/z 345.209 has low relative abundance (>1% relative to LE) in the laser ablation mass spectrum for the leaf tip. For the solvent extract, there are also many abundant ions observed with m/z>650 while no ions were observed in this range for laser ablation. This is likely due to the much longer dissolution time used for the solvent extraction compared to for laser ablation and due the different solvents used (acetonitrile for extraction and $H_2O$/MeOH for laser ablation).

Figure 6:
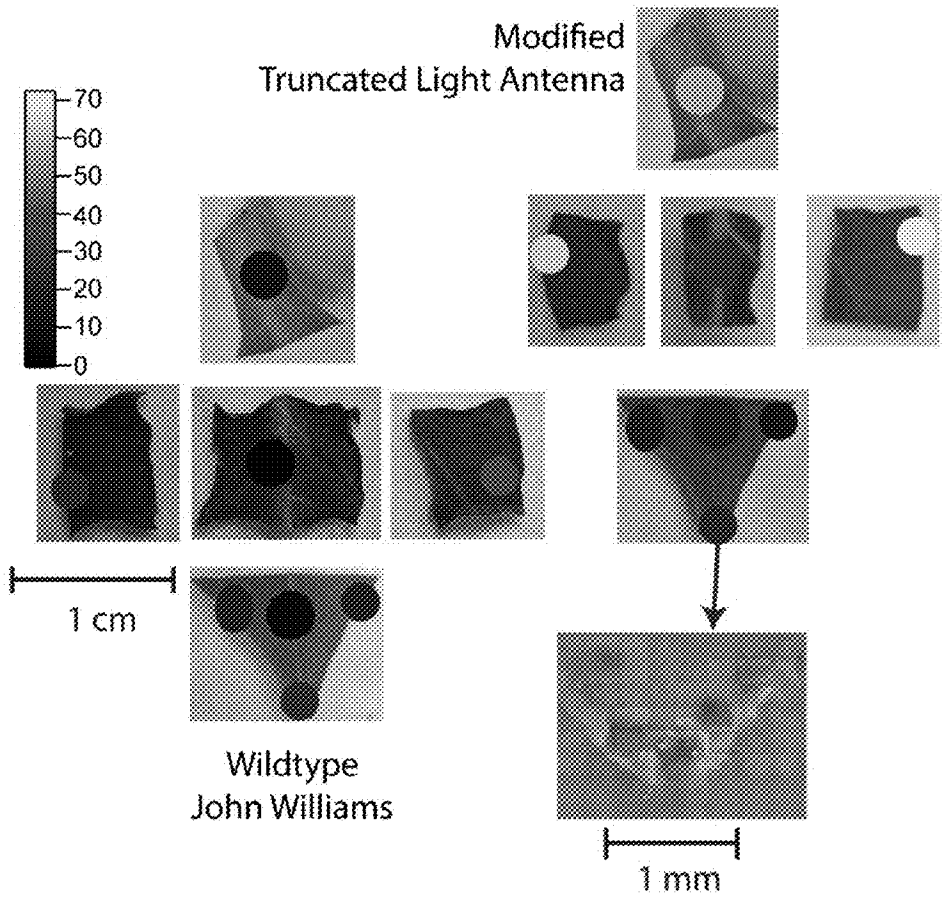
FIG. 6. Average nicotine abundances measured for laser ablation of three 360×360 μm areas of plant tissue from each of the circled areas of John Williams and TLA-mutant tobacco leaves. The average integrated nicotine abundance is indicated by the color of the circle. Blow up of the TLA-mutant tip shows ablation areas.

To visualize variations in the relative amount of nicotine for both the John Williams and TLA leaf samples, the color of the circles for each of the ablation areas was selected to correspond to the relative nicotine concentration at that location (FIG. 6). The nicotine levels for the TLA leaf were generally higher than for J W, by an average of 360%. The nicotine levels at the TLA mid-leaf edges, vein, and stem were higher by 200-1200%. The only areas that were lower were at the TLA tip edges, which had 65% of the nicotine measured for J W. The general spatial distribution of nicotine is similar for both plants; greater nicotine levels are observed at the leaf edges and tip with reduced concentration along the plant vein. The increased production of nicotine in the TLA leaf is consistent with previous metabolite analysis of TLA mutants which showed increased photosynthetic productivity for TLA mutated green microalgae.[55] Similar mapping for phosphoric acid intensity shows increased phosphoric acid concentration at the mid-vein and base/stem for both plant varieties and again with generally higher concentration for the TLA variety.

Mapping Nicotine Concentration from Leaf Edge to Interior.

Figure 7:
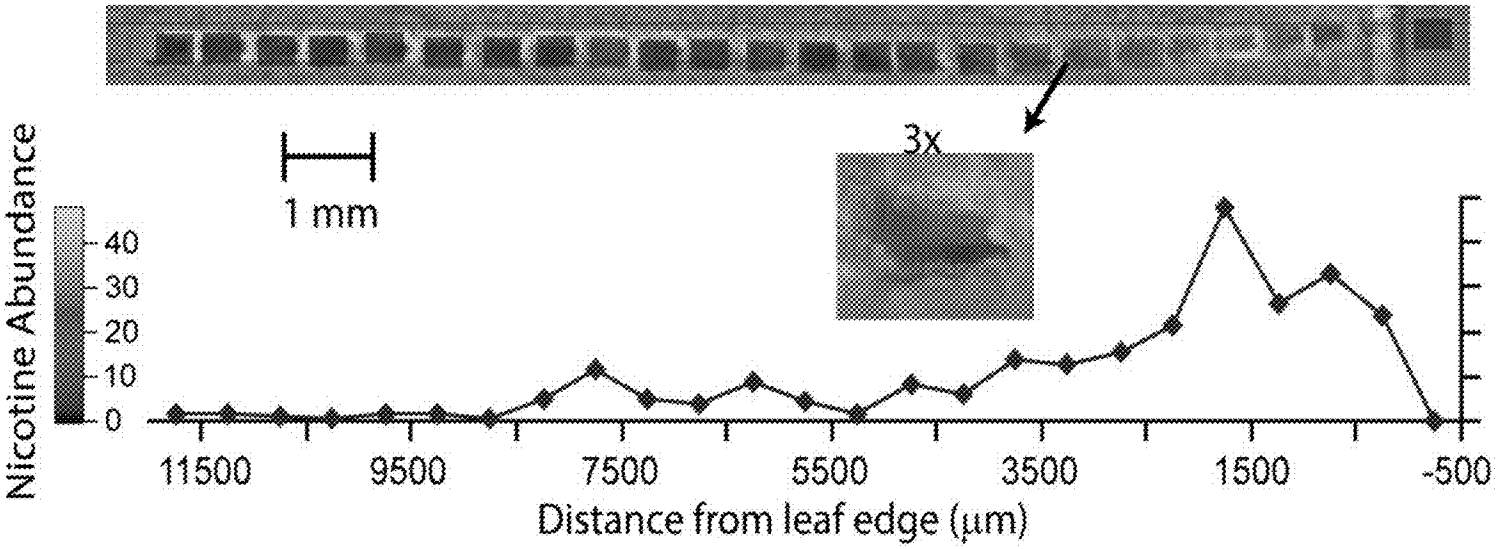
FIG. 7. The integrated nicotine abundance measured for laser ablation of 180×450 μm areas of tobacco leaf as a function of distance from leaf edge and the corresponding nicotine heatmap overlaid on a mosaic-captured image of the leaf sample. A 3× blowup of one of the ablation areas is shown. The distance of the ablation area from the leaf edge is indicated on the x-axis.

The nicotine concentration as a function of distance from the leaf edge was investigated by ablation experiments performed along a line perpendicular to the edge. Each ablation area consisted of a 2×5 grid of ablation spots or a ~180×450 μm total area. The first ablation area of the experiment was selected off of the leaf sample and as expected, no nicotine abundance was observed. The plot of the nicotine abundance and the nicotine heatmap overlaying a mosaic-capture image of the leaf sample are shown in FIG. 7. The nicotine abundance is highest within 2 mm of the leaf edge and decreases to ~3% of the maximum>8 mm from the leaf edge. The long cycle time for transferring and measuring material from a given ablation area (~3 mins) makes acquisition of 2D imaging of large areas very time consuming. However, gradient measurements, as shown for nicotine, aid in the investigation of chemical spatial distributions.

Conclusions.

An experimental setup for ambient IR laser ablation mass spectrometry (AIRLAB-MS) using an infrared microscope equipped with a reflecting objective and a continuous flow probe was investigated and high efficiency (~50%) was measured for transfer of material from glycerol/methanol droplets containing 1 mM nicotine to the ESI emitter. The high transfer efficiency relative to reported values for similar techniques is likely because of the combination of front-side laser ablation and the positioning of the probe droplet directly above the laser focus. Although not demonstrated here, this highly efficient laser ablation transfer coupled with an optimized electrospray ion source and modern commercial mass spectrometer should lead to much higher sensitivity which will make possible analysis of smaller area for significantly higher spatial resolution. The time required for sample ablation, transfer to the mass spectrometer and detection of all ablated material is 2-3 min which makes 2D imaging of large areas time consuming. However, the long duration of the nicotine signal (60-75 s) with AIRLAB-MS ahs the advantage that there is sufficient time to obtain detailed structural analysis with MS/MS techniques for many different ions. Results using AIRLAB-MS on a wild-type and mutant tobacco plant indicate higher nicotine concentrations at the leaf edges and tip relative to the leaf vein and stem, with higher nicotine concentrations for the mutant at all locations except the tip edges.

AIRLAB-MS is ideally suited for integrating visible microscopy, IR spectromicroscopy and spatially resolved mass spectrometry of the same sample. Studies combining IR spectromicroscopy, UV imaging and ToF-SIMS have been reported for analysis of liver tissue sections using a single sample holder, but separate instruments.[32-33] Similarly, Raman and fluorescence microspectroscopy have been combined with matrix-free MALDI of individual algae cells.[34] An advantage of AIRLAB-MS is that the same infrared microscope and sample stage is used for all of these techniques (visible, IR microscopies and imaging MS). Visible microscopy and IR spectromicroscopy can provide non-destructive chemical monitoring of living systems under environmentally controlled conditions and the visible/IR imaging can be used to select cells/areas of interest for detailed chemical analysis using AIRLAB-MS.

REFERENCES

1. Chen, L., et al., Synchrotron Infrared Measurements of Protein Phosphorylation in Living Single PC12 Cells during Neuronal Differentiation. *Anal. Chem.* 2012, 84, 4118-4125.
2. Shrestha, B.; Patt, J. M.; Vertes, A., In Situ Cell-by-Cell Imaging and Analysis of Small Cell Populations by Mass Spectrometry. *Anal. Chem.* 2011, 83, 2947-2955.
3. Quinn, K. P., et al., Quantitative metabolic imaging using endogenous fluorescence to detect stem cell differentiation. *Sci Rep* 2013, 3, 10.
4. Parsiegla, G.; Shrestha, B.; Carriere, F.; Vertes, A., Direct Analysis of Phycobilisomal Antenna Proteins and Metabolites in Small Cyanobacterial Populations by Laser Ablation Electrospray Ionization Mass Spectrometry. *Anal. Chem.* 2012, 84, 34-38.
5. Nemes, P.; Barton, A. A.; Vertes, A., Three-Dimensional Imaging of Metabolites in Tissues under Ambient Conditions by Laser Ablation Electrospray Ionization Mass Spectrometry. *Anal. Chem.* 2009, 81, 6668-6675.
6. Hazen, T. C., et al., Deep-Sea Oil Plume Enriches Indigenous Oil-Degrading Bacteria. *Science* 2010, 330, 204-208.
7. Mason, 0. U., et al., Metagenome, metatranscriptome and single-cell sequencing reveal microbial response to Deepwater Horizon oil spill. *Isme J.* 2012, 6, 1715-1727.
8. Probst, A. J., et al., Tackling the minority: sulfate-reducing bacteria in an archaea-dominated subsurface biofilm. *Isme J.* 2013, 7, 635-651.
9. Stolee, J. A.; Shrestha, B.; Mengistu, G.; Vertes, A., Observation of Subcellular Metabolite Gradients in Single Cells by Laser Ablation Electrospray Ionization Mass Spectrometry. *Angew. Chem.-Int. Edit.* 2012, 51, 10386-10389.
10. Terreno, E.; Delli Castelli, D.; Viale, A.; Aime, S., Challenges for Molecular Magnetic Resonance Imaging. *Chem. Rev.* 2010, 110, 3019-3042.
11. Ciobanu, L.; Webb, A. G.; Pennington, C. H., Magnetic resonance imaging of biological cells. *Prog. Nucl. Magn. Reson. Spectrosc.* 2003, 42, 69-93.
12. Palonpon, A. F.; Sodeoka, M.; Fujita, K., Molecular imaging of live cells by Raman microscopy. *Curr. Opin. Chem. Biol.* 2013, 17, 708-715.
13. Gierlinger, N.; Schwanninger, M., The potential of Raman microscopy and Raman imaging in plant research. *Spectr.-Int. J.* 2007, 21, 69-89.
14. Lippincott-Schwartz, J.; Snapp, E.; Kenworthy, A., Studying protein dynamics in living cells. *Nat. Rev. Mol. Cell Biol.* 2001, 2, 444-456.
15. Weiss, S., Fluorescence spectroscopy of single biomolecules. *Science* 1999, 283, 1676-1683.
16. Rubakhin, S. S.; Jurchen, J. C.; Monroe, E. B.; Sweedler, J. V., Imaging mass spectrometry: fundamentals and applications to drug discovery. *Drug Discov. Today* 2005, 10, 823-837.
17. Lanni, E. J.; Rubakhin, S. S.; Sweedler, J. V., Mass spectrometry imaging and profiling of single cells. *J. Proteomics* 2012, 75, 5036-5051.
18. McDonnell, L. A.; Heeren, R. M. A., Imaging mass spectrometry. *Mass Spectrom. Rev.* 2007, 26, 606-643.
19. van Hove, E. R. A.; Smith, D. F.; Heeren, R. M. A., A concise review of mass spectrometry imaging. *J. Chromatogr. A* 2010, 1217, 3946-3954.

20. Boxer, S. G.; Kraft, M. L.; Weber, P. K., Advances in Imaging Secondary Ion Mass Spectrometry for Biological Samples. In *Annual Review of Biophysics*, Annual Reviews: Palo Alto, 2009; Vol. 38, pp 53-74.
21. Lockyer, N. P.; Vickerman, J. C., Progress in cellular analysis using ToF-SIMS. *Appl. Surf Sci.* 2004, 231, 377-384.
22. Reyzer, M. L.; Caprioli, R. M., MALDI-MS-based imaging of small molecules and proteins in tissues. *Curr. Opin. Chem. Biol.* 2007, 11, 29-35.
23. Castellino, S.; Groseclose, M. R.; Wagner, D., MALDI imaging mass spectrometry: bridging biology and chemistry in drug development. *Bioanalysis* 2011, 3, 2427-2441.
24. Park, S. G.; Murray, K. K., Ambient laser ablation sampling for capillary electrophoresis mass spectrometry. *Rapid Commun. Mass Spectrom.* 2013, 27, 1673-1680.
25. Park, S. G.; Murray, K. K., Infrared laser ablation sample transfer for on-line liquid chromatography electrospray ionization mass spectrometry. *J. Mass Spectrom.* 2012, 47, 1322-1326.
26. Stolee, J. A.; Vertes, A., Toward Single-Cell Analysis by Plume Collimation in Laser Ablation Electrospray Ionization Mass Spectrometry. *Anal. Chem.* 2013, 85, 3592-3598.
27. Park, S. G.; Murray, K. K., Infrared Laser Ablation Sample Transfer for MALDI and Electrospray. *J. Am. Soc. Mass Spectrom.* 2011, 22, 1352-1362.
28. Takats, Z.; Wiseman, J. M.; Gologan, B.; Cooks, R. G., Mass spectrometry sampling under ambient conditions with desorption electrospray ionization. *Science* 2004, 306, 471-473.
29. Robichaud, G.; Barry, J. A.; Garrard, K. P.; Muddiman, D. C., Infrared Matrix-Assisted Laser Desorption Electrospray Ionization (IR-MALDESI) Imaging Source Coupled to a FT-ICR Mass Spectrometer. *J. Am. Soc. Mass Spectrom.* 2013, 24, 92-100.
30. Cornett, D. S.; Frappier, S. L.; Caprioli, R. M., MALDI-FTICR imaging mass spectrometry of drugs and metabolites in tissue. *Anal. Chem.* 2008, 80, 5648-53.
31. Masyuko, R.; Lanni, E. J.; Sweedler, J. V.; Bohn, P. W., Correlated imaging—a grand challenge in chemical analysis. *Analyst* 2013, 138, 1924-1939.
32. Le Naour, F., et al., Chemical Imaging on Liver Steatosis Using Synchrotron Infrared and ToF-SIMS Microspectroscopies. *PLoS One* 2009, 4, 10.
33. Petit, V. W., et al., Multimodal Spectroscopy Combining Time-of-Flight-Secondary Ion Mass Spectrometry, Synchrotron-FT-IR, and Synchrotron-UV Microspectroscopies on the Same Tissue Section. *Anal. Chem.* 2010, 82, 3963-3968.
34. Urban, P. L.; Schmid, T.; Amantonico, A.; Zenobi, R., Multidimensional Analysis of Single Algal Cells by Integrating Microspectroscopy with Mass Spectrometry. *Anal. Chem.* 2011, 83, 1843-1849.
35. Adriaensen, L.; Vangaever, F.; Lenaerts, J.; Gijbels, R., Matrix-enhanced secondary ion mass spectrometry: the influence of MALDI matrices on molecular ion yields of thin organic films. *Rapid Commun. Mass Spectrom.* 2005, 19, 1017-1024.
36. Roach, P. J.; Laskin, J.; Laskin, A., Nanospray desorption electrospray ionization: an ambient method for liquid-extraction surface sampling in mass spectrometry. *Analyst* 2010, 135, 2233-2236.
37. Laskin, J., et al., Tissue Imaging Using Nanospray Desorption Electrospray Ionization Mass Spectrometry. *Anal. Chem.* 2012, 84, 141-148.
38. Van Berkel, G. J., et al., Liquid microjunction surface sampling probe electrospray mass spectrometry for detection of drugs and metabolites in thin tissue sections. *J. Mass Spectrom.* 2008, 43, 500-508.
39. Kertesz, V.; Van Berkel, G. J., Fully automated liquid extraction-based surface sampling and ionization using a chip-based robotic nanoelectrospray platform. *J. Mass Spectrom.* 2010, 45, 252-260.
40. Van Berkel, G. J.; Kertesz, V., Continuous-flow liquid microjunction surface sampling probe connected on-line with high-performance liquid chromatography/mass spectrometry for spatially resolved analysis of small molecules and proteins. *Rapid Commun. Mass Spectrom.* 2013, 27, 1329-1334.
41. Peng, I. X., et al., Electrospray-assisted laser desorption ionization mass spectrometry (ELDI-MS) with an infrared laser for characterizing peptides and proteins. *Analyst* 2010, 135, 767-772.
42. Shiea, J., et al., Electrospray-assisted laser desorption/ionization mass spectrometry for direct ambient analysis of solids. *Rapid Commun. Mass Spectrom.* 2005, 19, 3701-3704.
43. Li, Y.; Shrestha, B.; Vertes, A., Atmospheric pressure molecular imaging by infrared MALDI mass spectrometry. *Anal. Chem.* 2007, 79, 523-532.
44. Li, Y.; Shrestha, B.; Vertes, A., Atmospheric pressure infrared MALDI imaging mass spectrometry for plant metabolomics. *Anal. Chem.* 2008, 80, 407-420.
45. Sampson, J. S.; Hawkridge, A. M.; Muddiman, D. C., Generation and detection of multiply-charged peptides and proteins by matrix-assisted laser desorption electrospray ionization (MALDESI) Fourier transform ion cyclotron resonance mass spectrometry. *J. Am. Soc. Mass Spectrom.* 2006, 17, 1712-1716.
46. Sampson, J. S.; Murray, K. K.; Muddiman, D. C., Intact and Top-Down Characterization of Biomolecules and Direct Analysis Using Infrared Matrix-Assisted Laser Desorption Electrospray Ionization Coupled to FT-ICR, Mass Spectrometry. *J. Am. Soc. Mass Spectrom.* 2009, 20, 667-673.
47. Nemes, P.; Vertes, A., Laser ablation electrospray ionization for atmospheric pressure, in vivo, and imaging mass spectrometry. *Anal. Chem.* 2007, 79, 8098-8106.
48. Ovchinnikova, 0. S.; Kertesz, V.; Van Berkel, G. J., Combining Laser Ablation/Liquid Phase Collection Surface Sampling and High-Performance Liquid Chromatography-Electrospray Ionization-Mass Spectrometry. *Anal. Chem.* 2011, 83, 1874-1878.
49. Ovchinnikova, 0. S.; Lorenz, M.; Kertesz, V.; Van Berkel, G. J., Laser Ablation Sampling of Materials Directly into the Formed Liquid Microjunction of a Continuous Flow Surface Sampling Probe/Electrospray Ionization Emitter for Mass Spectral Analysis and Imaging. *Anal. Chem.* 2013, 85, 10211-10217.
50. Apitz, I.; Vogel, A., Material ejection in nanosecond Er:YAG laser ablation of water, liver, and skin. *Appl. Phys. A-Mater. Sci. Process.* 2005, 81, 329-338.
51. Nemes, P.; Huang, H. H.; Vertes, A., Internal energy deposition and ion fragmentation in atmospheric-pressure mid-infrared laser ablation electrospray ionization. *Phys. Chem. Chem. Phys.* 2012, 14, 2501-2507.
52. Bush, M. F., et al., Infrared spectroscopy of cationized arginine in the gas phase: Direct evidence for the transition from nonzwitterionic to zwitterionic structure. *J. Am. Chem. Soc.* 2007, 129, 1612-1622.

53. Bombarely, A., et al., The Sol Genomics Network (solgenomics.net): growing tomatoes using Perl. *Nucleic Acids Res.* 2011, 39, D1149-D1155.

54. Jassbi, A. R.; Zamanizadehnajari, S.; Kessler, D.; Baldwin, I. T., A new acyclic diterpene glycoside from *Nicotiana attenuata* with a mild deterrent effect on feeding *Manduca sexta* larvae. *Z. Naturforsch.* (*B*) 2006, 61, 1138-1142.

55. Polle, J. E. W.; Kanakagiri, S. D.; *Melis*, A., tlal, a DNA insertional transformant of the green alga *Chlamydomonas reinhardtii* with a truncated light-harvesting chlorophyll antenna size. *Planta* 2003, 217, 49-59.

The above examples are provided to illustrate the invention but not to limit its scope. Other variants of the invention will be readily apparent to one of ordinary skill in the art and are encompassed by the appended claims. All publications, databases, and patents cited herein are hereby incorporated by reference for all purposes.

What is claimed is:

1. A system for spatially resolved ambient infrared laser ablation mass spectrometry (AIRLAB-MS) comprising an infrared microscope with an infinity-corrected reflective objective, an infrared laser, a continuous flow solvent probe coupled to a mass spectrometer having an electrospray ionization emitter, and a stage for the sample to be subjected to laser ablation mass spectrometry.

2. The system of claim 1, wherein the continuous flow probe is assembled and fitted to connect to the mass spectrometry emitter, and wherein the continuous flow probe having an outer diameter (OD), and inner diameter (ID) capillary and wherein the outer capillary is open and notched at the tip of the probe allowing a solvent drop to be exposed to capture the ablated sample.

3. The system of claim 1, further comprising a pump connected to the continuous flow probe such that solvent from a pump is continuously flowed to the tip of the probe in the outer diameter capillary of the probe and captures the ablated sample plume after ablation into the inner diameter capillary of the probe, transferring the sample to the mass spectrometry emitter.

4. The system of claim 3, having an efficiency of material transfer from the sample to the electrospray ionization emitter of about 50%.

5. The system of claim 1 wherein the infinity-corrected reflective objective focuses the laser directly under probe droplet over the sample on the stage.

6. The system of claim 1 wherein the IR laser emits 2.94 μm light.

* * * * *